US008807470B2

(12) United States Patent
Eblen et al.

(10) Patent No.: US 8,807,470 B2
(45) Date of Patent: Aug. 19, 2014

(54) BUSHING AND SPACER SYSTEM FOR HAMMER MILLS

(75) Inventors: Geoff Eblen, Lees Summit, MO (US); Don Peacher, Gladstone, MO (US)

(73) Assignee: Southwest Mill Supply Company, Kansas City, MO (US)

( * ) Notice: Subject to any disclaimer, the term of this patent is extended or adjusted under 35 U.S.C. 154(b) by 144 days.

(21) Appl. No.: 13/397,526

(22) Filed: Feb. 15, 2012

(65) Prior Publication Data

US 2012/0205476 A1 Aug. 16, 2012

Related U.S. Application Data

(60) Provisional application No. 61/443,147, filed on Feb. 15, 2011.

(51) Int. Cl.
*B02C 13/04* (2006.01)

(52) U.S. Cl.
USPC ..... 241/189.1; 241/191; 241/193; 241/194

(58) Field of Classification Search
CPC .... B02C 13/2804; B02C 13/06; B02C 13/28; B02C 13/02; B02C 13/095
USPC ..... 241/189.1, 191, 193, 194
See application file for complete search history.

(56) References Cited

U.S. PATENT DOCUMENTS

| | | | | |
|---|---|---|---|---|
| 4,202,078 | A * | 5/1980 | Malinak | 19/26 |
| 4,637,406 | A * | 1/1987 | Guinn et al. | 460/112 |
| 5,188,303 | A * | 2/1993 | Hoof | 241/194 |
| 5,240,190 | A * | 8/1993 | Johnson | 241/74 |
| 6,491,240 | B1 * | 12/2002 | Veeck et al. | 241/34 |
| 7,419,109 | B1 * | 9/2008 | Ronfeldt et al. | 241/189.1 |

* cited by examiner

*Primary Examiner* — Faye Francis
*Assistant Examiner* — Onekki Jolly
(74) *Attorney, Agent, or Firm* — Hovey Williams LLP

(57) ABSTRACT

A bushing and spacer system for use with hammer mills is configured to be mounted on a hammer mill rod to receive and support a plurality of hammers such that the surface of the rod is shielded from contact with the hammers, and such that the hammers are positioned in spaced relationship one with another. The bushing and spacer system includes at least a first bushing and a second bushing mounted on the hammer rod. The second bushing includes a spacer portion and a neck portion, the spacer portion presenting a larger cross section than the neck portion. The second bushing is mounted on the rod such that the neck portion of the second bushing is adjacent the first bushing. A hammer is rotatably mounted on the neck portion of the second bushing.

16 Claims, 10 Drawing Sheets

BUSHING AND SPACER SYSTEM FOR HAMMER MILLS

RELATED APPLICATIONS

This non-provisional patent application claims priority benefit with regard to all common subject matter of earlier-filed U.S. provisional patent application titled BUSHING AND SPACER SYSTEM FOR HAMMER MILLS, filed Feb. 15, 2011, and assigned application No. 61/443,147. The earlier-filed provisional application is hereby incorporated by reference in its entirety into the present application.

BACKGROUND

1. Field

Embodiments of the present invention relate to bushing and spacer systems for use with hammer mills. More particularly, embodiments of the present invention relate to bushings configured to be mounted on a hammer rod and to receive hammers such that the bushings support the hammers, shield the rod from contact with the hammers, and separate the hammers one from another.

2. Related Art

Hammer mills, sometimes referred to as impact grinders, are well known in the art and are used for grinding or comminuting materials such as scrap metal, forestry and agricultural materials, minerals, recycling materials, and food components such as grain. A typical hammer mill comprises a rotor mounted on a rotor shaft that is driven by a motor. The rotor includes a series of rotor discs spaced axially along the rotor shaft, and a plurality of hammer rods mounted on the rotor discs and extending the length of the rotor. The hammer rods are spaced radially outwardly from the rotor shaft and spaced circumferentially from one another. A plurality of free-swinging "hammers," typically planar, elongated metal pieces, are mounted on the rods such that when the motor induces rotational movement in the rotor, the hammers extend radially outwardly from the rotor responsive to the centrifugal force associated with the rotation of the rotor.

An enclosure surrounds the rotor and includes a material inlet typically located at a top of the enclosure for allowing material to be dropped into the hammer mill for grinding. The enclosure may further comprise a perforated wall at least partially defining a grinding chamber, wherein the perforated wall enhances the grinding process and filters material particles from the grinding chamber as they are sufficiently reduced in size.

Because the hammers rotate and otherwise move on the rods, both the hammers and rods tend to wear over time at the points of contact. Over time this wearing tends to cause the hammer apertures to elongate and the rods to develop grooves. Such wearing can cause the hammers to extend radially outwardly relative to the rotor which can, in turn, cause the hammers to come into contact with the enclosure, potentially damaging both the hammers and the enclosure if not corrected.

Accordingly, there is a need for an improved hammer mill which overcomes the limitations described above.

SUMMARY

A bushing system for a hammer mill in accordance with an embodiment of the invention comprises a rod, a first bushing mounted on the rod, and a second bushing mounted on the rod. The second bushing includes a spacer portion and a neck portion, the spacer portion presenting a larger cross section than the neck portion. The second bushing is mounted on the rod such that the neck portion of the second bushing is adjacent the first bushing. A hammer is rotatably mounted on the neck portion of the second bushing.

A bushing system for a hammer mill in accordance with another embodiment of the invention comprises a rod, a first bushing removably mounted on the rod, and a second bushing removably mounted on the rod. The first bushing includes a cylindrical spacer portion corresponding to a first axial end of the bushing and a cylindrical neck portion corresponding to a second axial end of the bushing, the spacer portion presenting a larger outer diameter than the neck portion and including a cylindrical recess. The second bushing includes a cylindrical spacer portion corresponding to a first axial end and a cylindrical neck portion corresponding to a second axial end, the spacer portion presenting a larger outer diameter than the neck portion. The second bushing is mounted on the rod such that the neck portion of the second bushing matingly engages the cylindrical recess of the first bushing.

A hammer presents an elongated, planar shape with a circular aperture proximate an end of the hammer. The circular aperture presents a diameter that is greater than the outer diameter of the neck portion of the second bushing but less than the outer diameter of each of the spacer portions of the first and second bushings. The hammer is mounted on the neck portion of the second bushing such that the aperture rotatably engages the neck portion.

A method of assembling a bushing system for a hammer-mill in accordance with yet another embodiment of the invention comprises mounting a first bushing on a hammer rod, the first bushing including a neck portion and a spacer portion, and placing a hammer on the first bushing by sliding a circular aperture of the hammer over the neck portion of the first bushing. A second bushing is mounted on the hammer rod, the second bushing including a neck portion and a spacer portion. The second bushing is mounted on the hammer rod such that the neck portion of the first bushing matingly engages the spacer portion of the first bushing and a distance between the spacer portion of the first bushing and the spacer portion of the second bushing is slightly more than a thickness of the hammer.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

Figure 1:
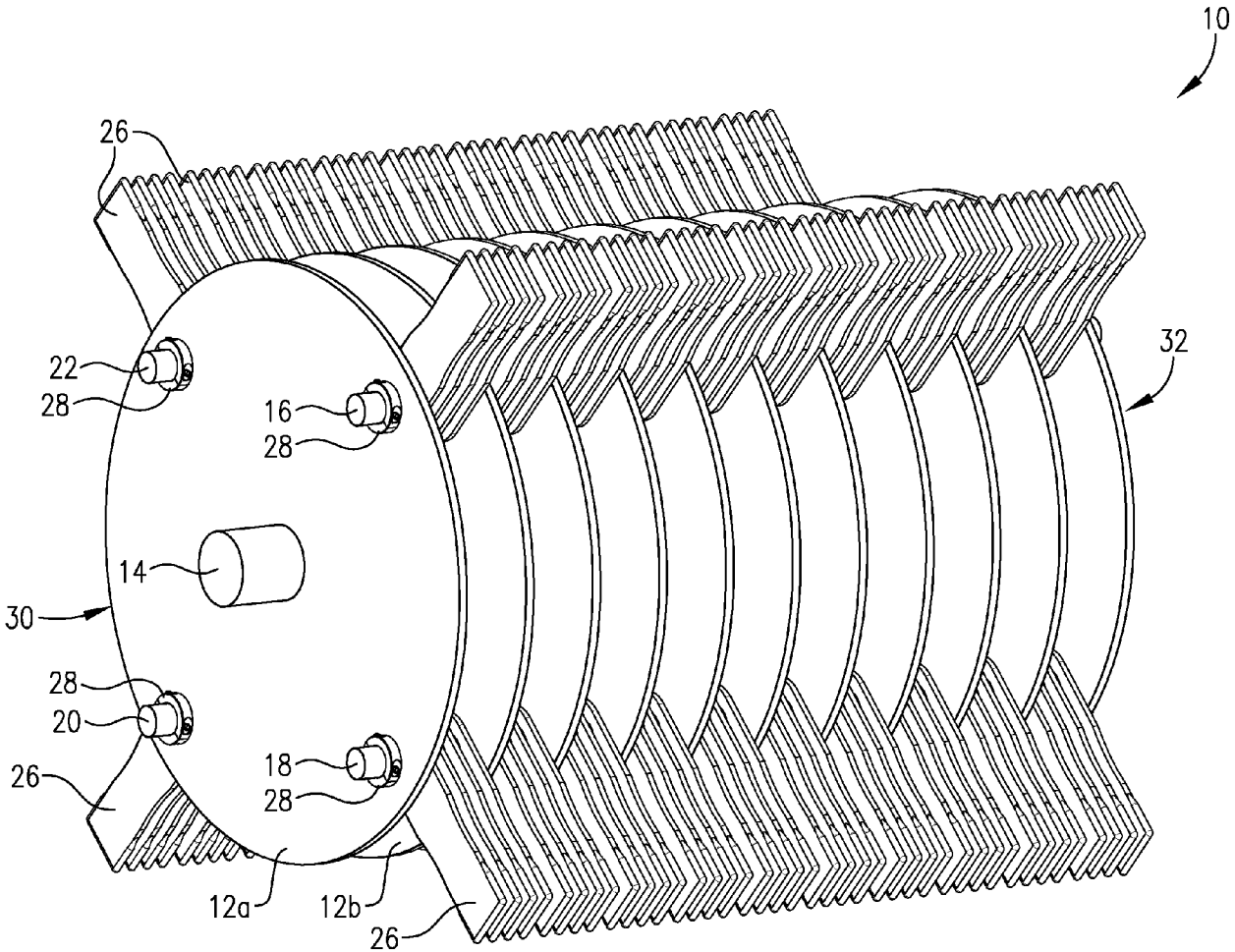
FIG. 1 is a perspective view of a hammer mill rotor including a bushing and spacer system constructed according to principles of the present invention, illustrating the hammers in an operational position wherein the hammers are extended radially relative to the rotor.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
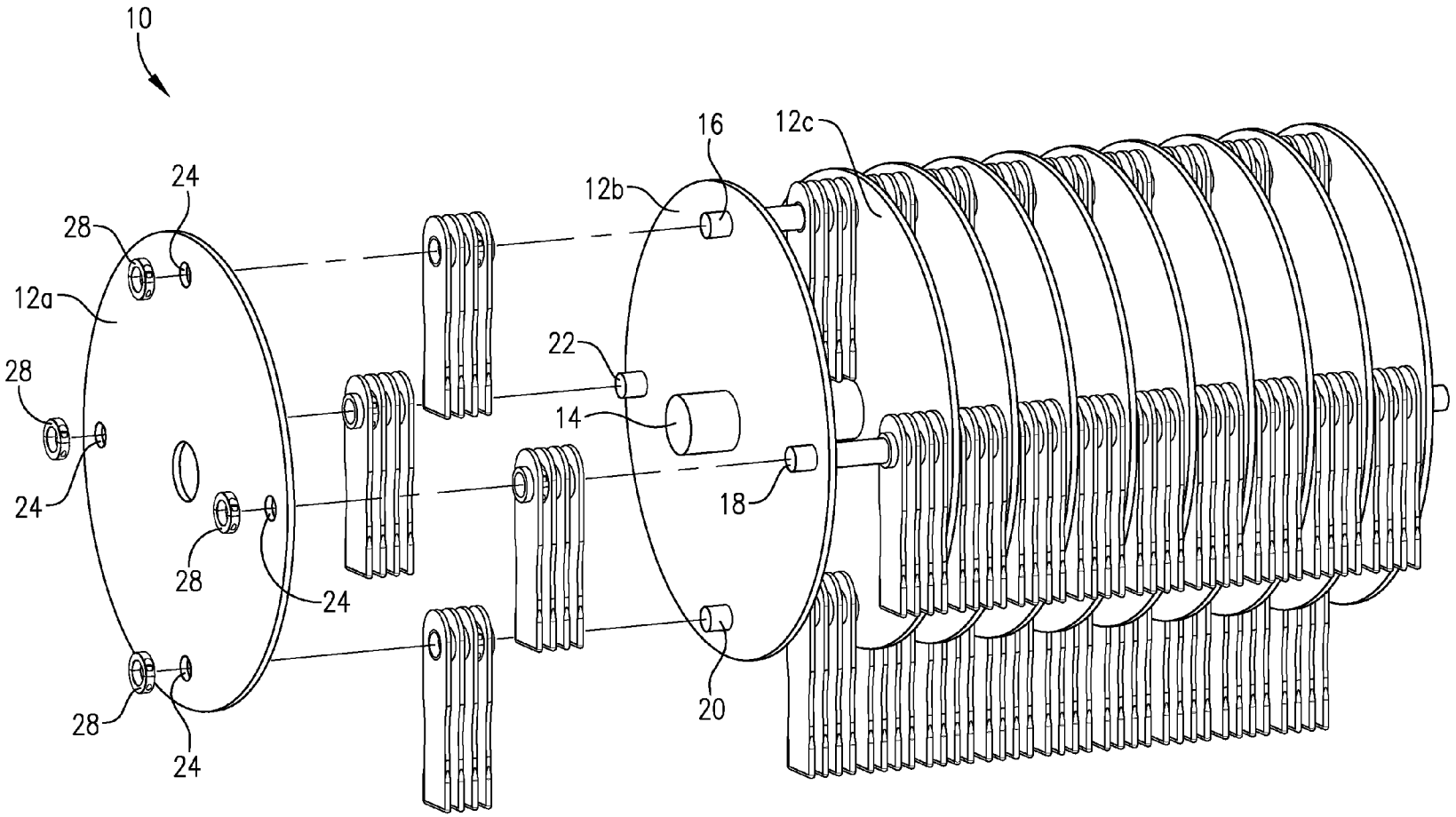
FIG. 2 is a partially exploded view of the hammer mill rotor of FIG. 1, illustrating the hammers in an idle position wherein the hammers depend downwardly from the rods.
Figure 3:
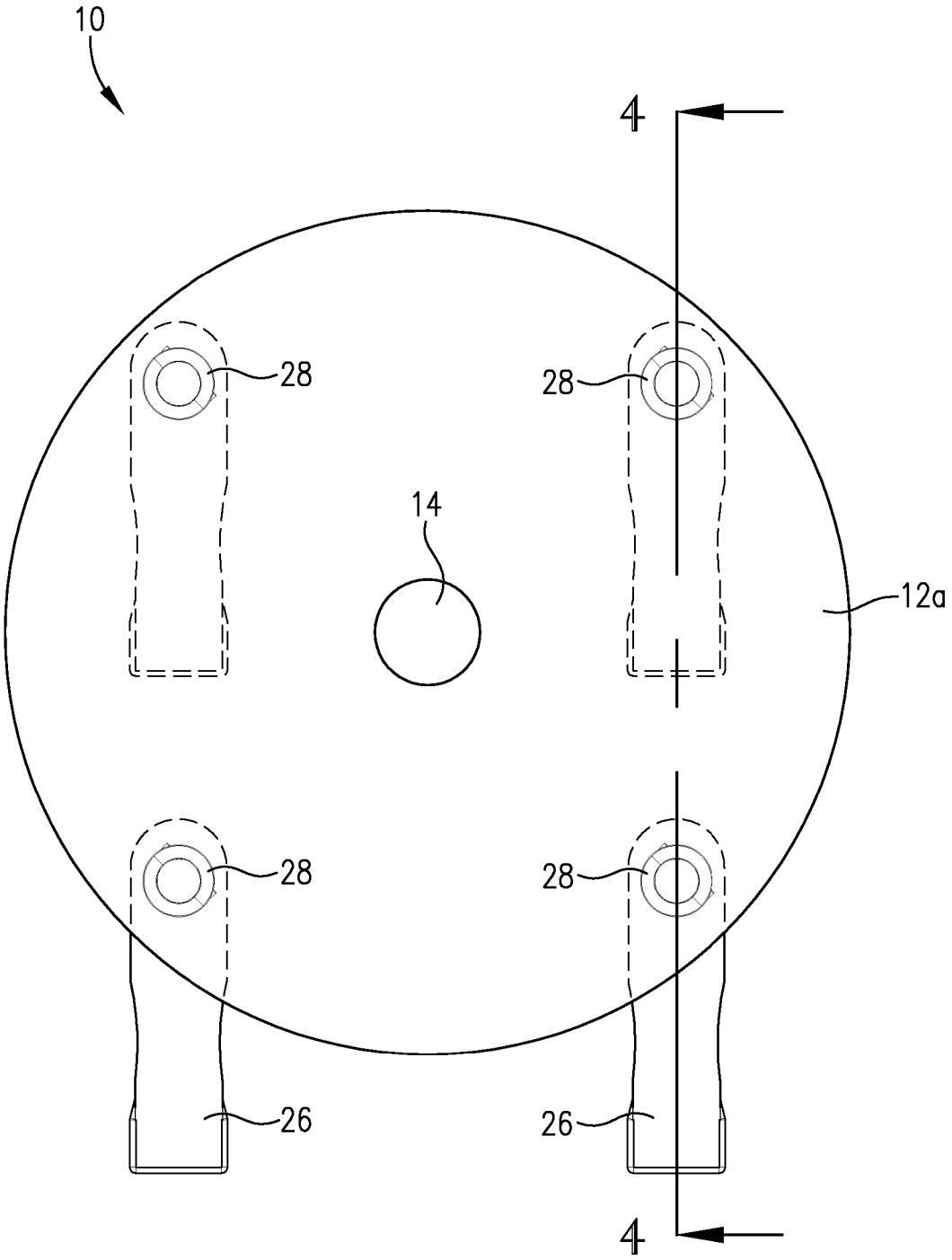
FIG. 3 is an end elevation view of the hammer mill rotor of FIG. 2.
Figure 5:
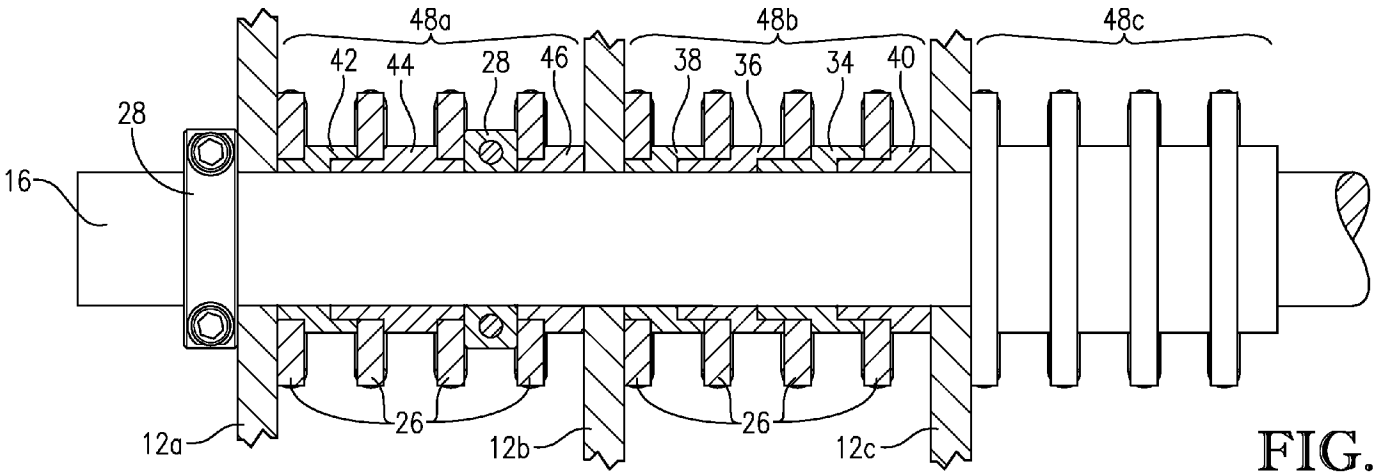
FIG. 5 is a fragmentary, partially cross-sectional plan view of a first of the hammer rods of the hammer mill rotor of FIG. 2, illustrating the bushing and spacer system with bushings placed on the rod according to a first pattern.
Figure 6:
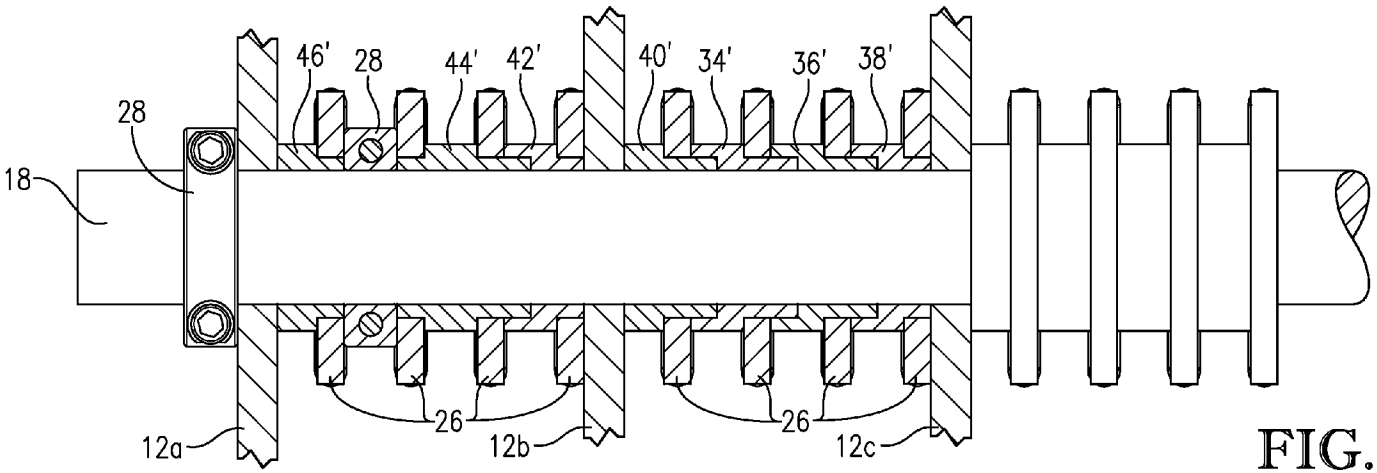
FIG. 6 is a fragmentary, partially cross-sectional plan view of a second of the hammer rods of the hammer mill rotor of FIG. 2, illustrating the bushing and spacer system with bushings placed on the rod according to a second pattern.

Turning now to the drawings, an exemplary hammer mill rotor 10 including a bushing and spacer system embodying principles of the present invention is illustrated. The rotor 10 includes a plurality of rotor discs 12 approximately equally spaced along a longitudinal axis of a rotor shaft 14. The shaft 14 is drivingly coupled to a motor (not shown) such that, during operation, the motor induces rotational movement in the rotor 10. A plurality of hammer rods 16,18,20,22 are mounted in axially-aligned disc apertures 24 and are positioned generally parallel with, and radially outwardly from, the rotor shaft 14. A plurality of free-swinging hammers 26 are mounted on each of the hammer rods 16,18,20,22 such that during operation the hammers 26 tend toward radially extended positions, as illustrated in FIG. 1, due to rotation of the rotor 10. When the rotor 10 is at rest the hammers 26 depend from the hammer rods 16,18,20,22, as illustrated in FIG. 2. A plurality of locking collars 28 may be placed on the rods 16,18,20,22 at a first end 30 of the rotor 10, a second end 32 of the rotor 10, or both. Furthermore, locking collars may be placed on the rods 16,18,20,22 at one or more intermediate points between the rotor discs 12, as illustrated in FIGS. 5 and 6 and explained below in greater detail.

The first rod 16 and third rod 20 are generally positioned on opposite sides of the rotor shaft 14, while the second rod 18 and the fourth rod 22 are generally positioned on opposite sides of the rotor shaft 14. The first and third rods 16,20 generally lie on a line that is perpendicular to a line that intersects the second and fourth rods 18,22. Thus, the rods 16,18,20,22 are generally equally circumferentially spaced around the rotor 10.

A plurality of bushings, such as bushings 34-46, are mounted on each of the hammer rods 16,18,20,22 and are configured to both support the hammers 26 and maintain the hammers 26 in a spaced relationship with each other. The hammers 26 are mounted on the bushings such that the hammers do not contact the rods 16,18,20,22, thus the bushings shield the rods 16,18,20,22 from the hammers 26 and the wear associated with the movement of hammers 26 relative to the rods 16,18,20,22. Because the bushings support and hammers 26 and are exposed to the rigors of hammer mill operation—including potentially abrasive movement of the hammers 26 relative to the bushings—the bushings are preferably constructed of a hard, resilient material such as steel or aluminum.

Figure 4:
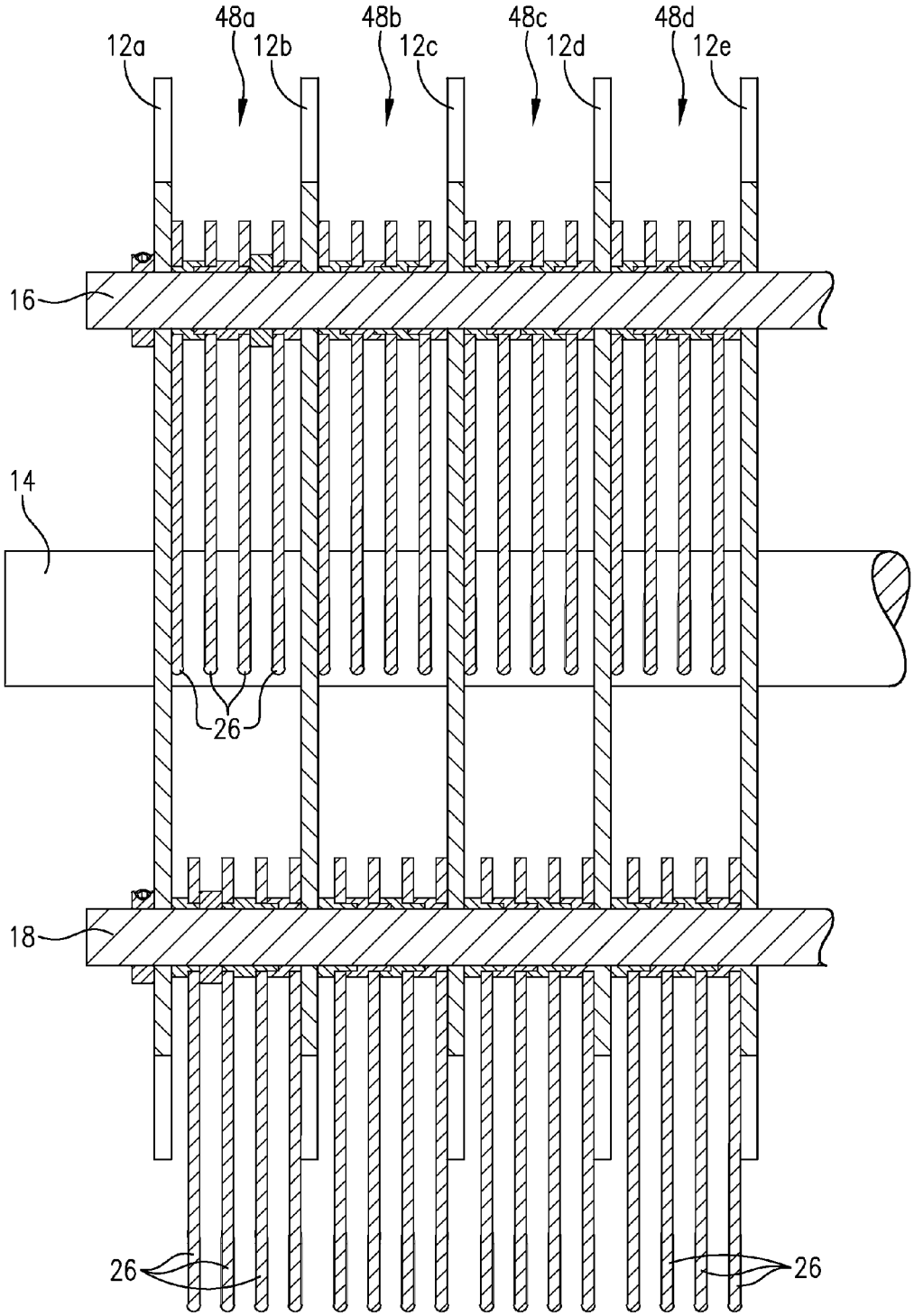
FIG. 4 is a fragmentary cross-sectional side elevation view of the hammer mill rotor of FIG. 2, corresponding to line 4-4 of FIG. 3, illustrating the bushing and spacer system wherein each of the bushings includes a neck portion and a spacer portion and at least some of the bushings are in an overlapping relationship with one another.

In the illustrated embodiment, the rotor 10 is divided into sections 48 delineated by the rotor discs 12. A plurality of hammers 26 are associated with each rod 16,18,20,22 in each section 48 and are mounted on a series of bushings that spans each section. The particular dimensions and configuration of each of the bushings, as well as the placement pattern of the bushings, depends on the length of the particular section 48, the size of the hammers 26, the desired hammer pattern, and the presence of other elements placed in the section, such as locking collars 28. The illustrated rotor 10 includes two hammer patterns and corresponding bushing placement patterns, wherein a first rod 16 and a third rod 20 each present a first bushing pattern, and a second rod 18 and fourth rod 22 each present a second bushing pattern. The different patterns enable staggered or offset placement of the hammers 26, as illustrated in FIGS. 4 through 6. Because the first rod 16 is circumferentially followed by the second rod 18, which is followed by the third rod 20 then by the fourth rod 22, consecutive rods present different or offset hammer patterns.

The two bushing placement patterns that enable the staggered hammer patterns are illustrated in FIGS. 5 and 6. FIG.

Figure 7A:
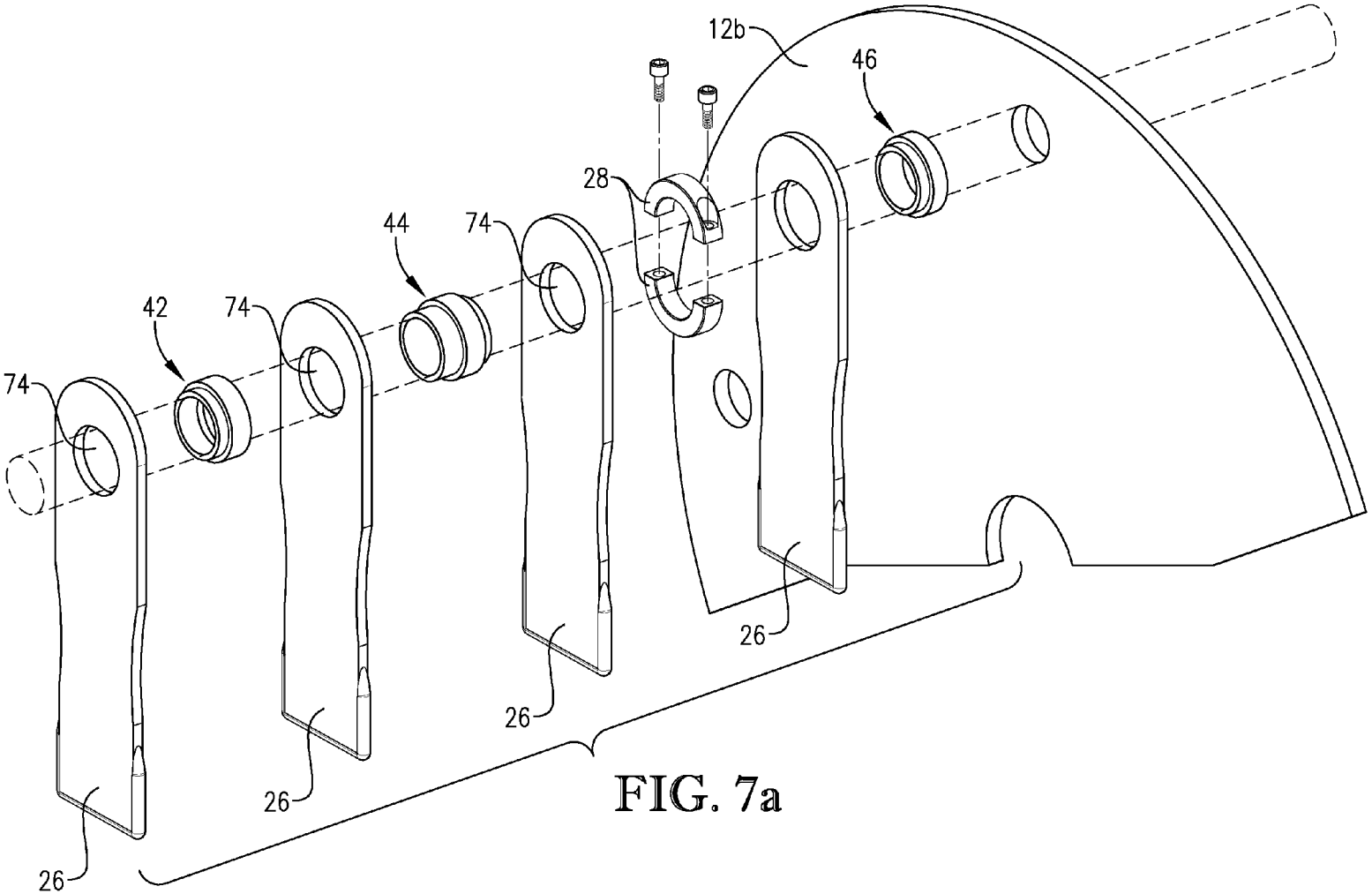
FIG. 7*a* is an exploded view of the bushing system corresponding to a first, end section of the rod of FIG. 5.
Figure 7B:
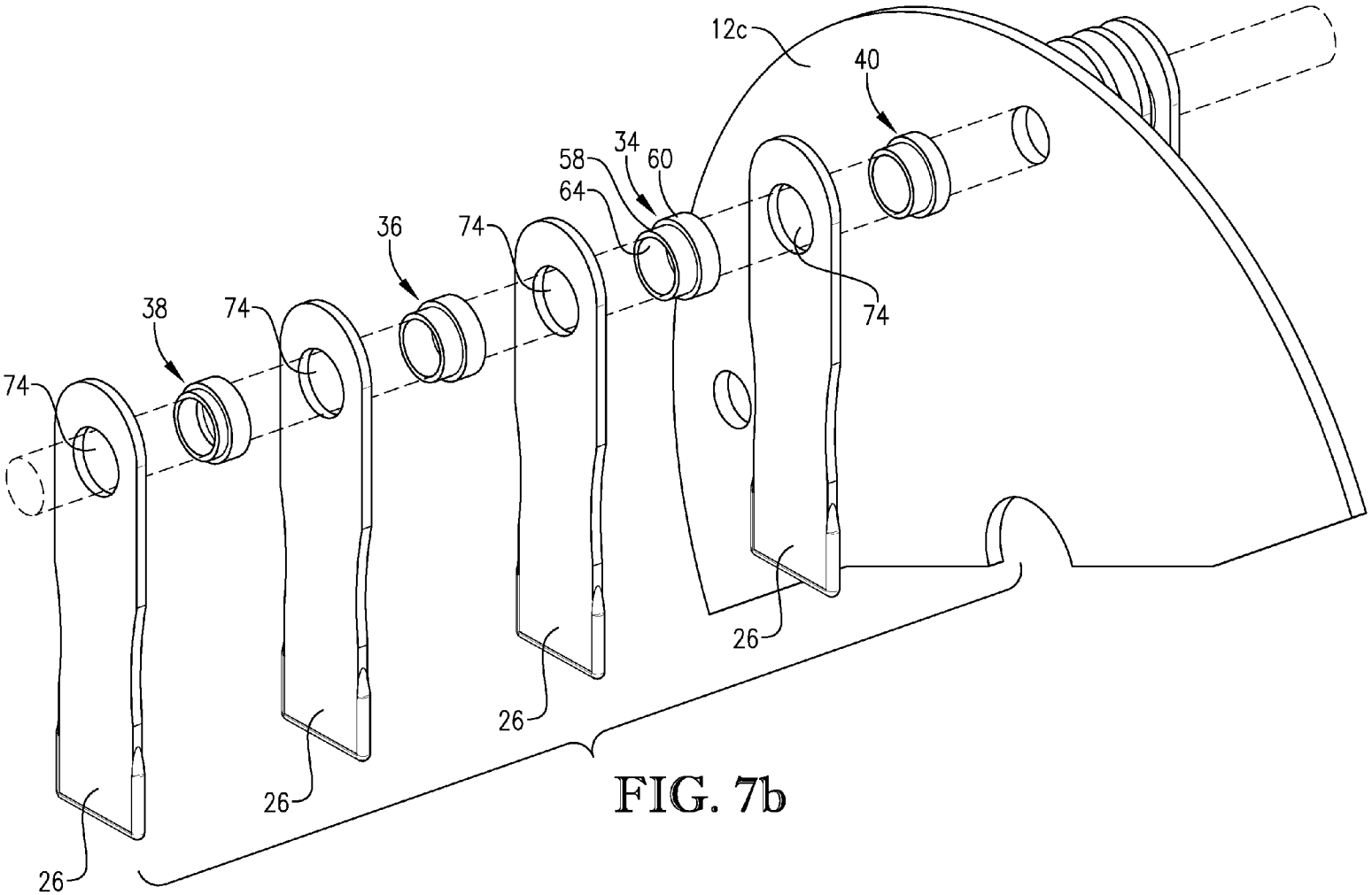
FIG. 7*b* is an exploded view of the bushing system corresponding to a second section of the rod of FIG. 5 proximate the first section.
Figure 8A:
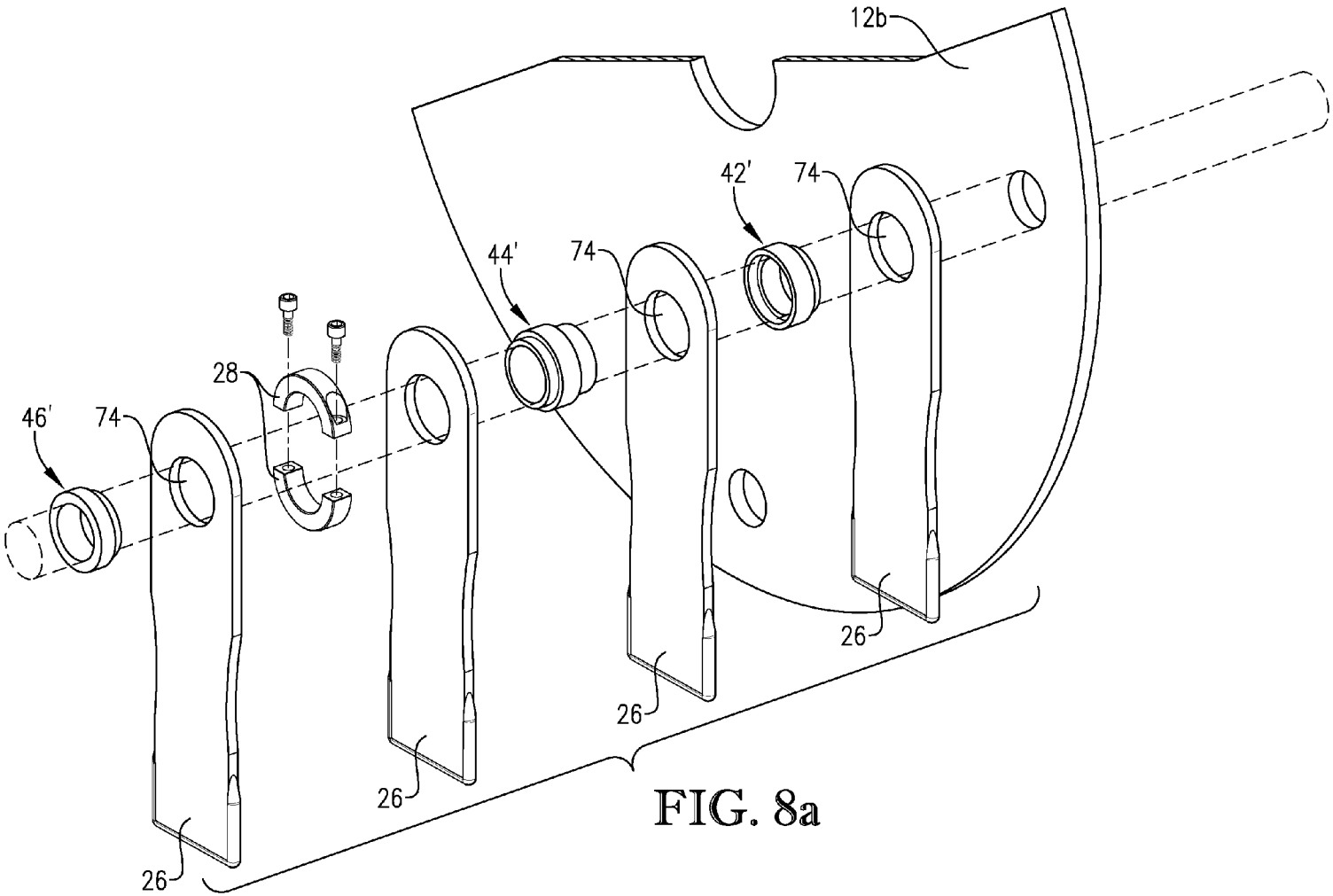
FIG. 8*a* is an exploded view of the bushing system corresponding to a first, end section of the rod of FIG. 6.
Figure 8B:
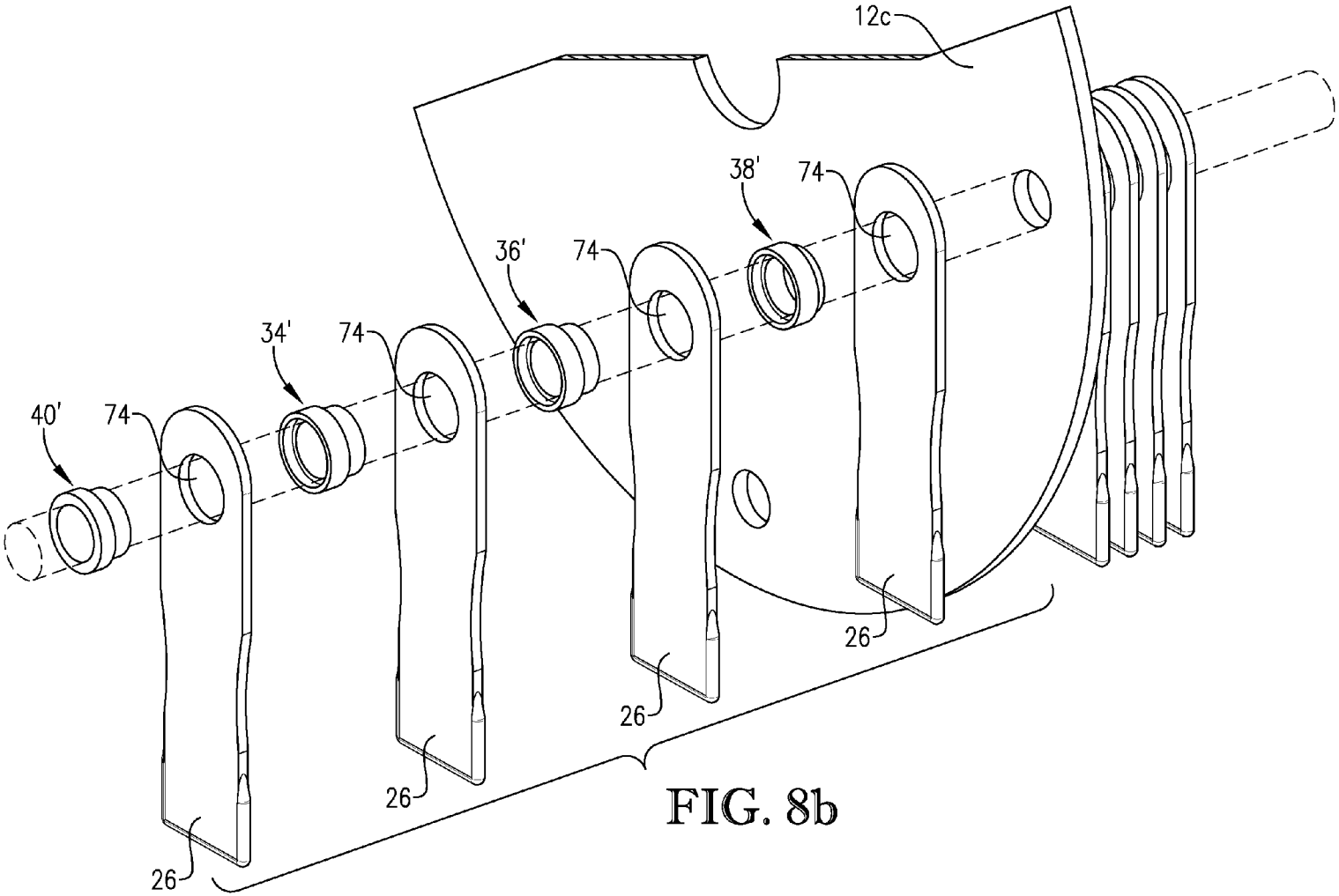
FIG. 8*b* is an exploded view of the bushing system corresponding to a second section of the rod of FIG. 6 proximate the first section.

5 illustrates a bushing pattern on the first rod 16, which may be identical to the bushing pattern on the third rod 20. FIG. 6 illustrates a bushing pattern on the second rod 18, which may be identical to the bushing pattern on the fourth rod 22. With reference to the second section 48*b* of the first rod 16 illustrated in FIGS. 5 and 7*b*, each of the bushings include a neck portion and a spacer portion, and three of the four bushings include a recess for receiving the neck portion of an adjacent bushing.

More particularly, and with particular reference to a first bushing 34, the bushing 34 generally cylindrical in shape and configured to partially or completely encircle the rod 16 when slidably mounted thereon. The bushing 34 presents a neck portion 50 corresponding to a first axial end 52 and a spacer portion 54 corresponding to a second axial end 56. The neck portion 50 is defined by a first cylindrical outer surface 58 and the spacer portion 54 is defined by a second cylindrical outer surface 60, the second outer surface 60 presenting a larger diameter than the first outer surface 58. An outer annular shoulder 62 adjoins the first 58 and second 60 outer cylindrical surfaces.

A first inner cylindrical surface 64 runs part of the axial length of the bushing 34, extending from the first axial end 52 to a recess 66 adjacent the second axial end. The recess 66 may be an annular recess defined by a second inner cylindrical surface 68 presenting a larger diameter than the first inner cylindrical surface 64. An inner annular shoulder 70 adjoins the first 64 and second 68 inner cylindrical surfaces.

The bushing 34 may be configured to be slidably mounted on the rod 16 and to matingly engage an adjacent, identically configured second bushing 36.

Therefore, the first inner surface 64 presents a diameter that is slightly greater than an outer diameter of the rod 16. Furthermore, the first cylindrical outer surface 58 of the bushing 34 corresponding to the neck portion 50 presents a diameter that is slightly less than the second inner surface 68 of the bushing 34 corresponding to the recess 66 such that the neck portion 50 may slidably engage a recess of the second bushing 36, as illustrated in FIG. 5. When the first 34 and second 36 bushings are thus engaged, an outer rim 72 of the neck portion 50 of the first bushing 34 may engage an inner annular shoulder of the second bushing 36.

The first 34 and second 36 bushings and the hammers 26 are configured such that a hammer 26 is rotatably mounted on the neck portion 50 of the first bushing 34 and between the spacer portions 54 of the first 34 and second 36 bushings. Thus, the neck portion 50 of the first bushing 34 and the neck portion 50 of the second bushing 36 each present an axial length $d_3$ that is sufficient to extend through the aperture 74 of a hammer 26 and into a recess of an adjacent bushing. The spacer portions 54 of the first 34 and the second 36 bushings prevent lateral movement of a hammer 26 mounted on a neck portion 50 between the two spacer portions 54, that is, movement in a direction parallel with a longitudinal axis of the rod 16.

It will be appreciated by those skilled in the art that because the hammers 26 are mounted on the bushings rather than directly on the hammer rods 16,18,20,22, the bushings shield the rods 16,18,20,22 from wear that would otherwise occur due to contact between the hammers 26 and the rods 16,18, 20,22. With the illustrated bushing and spacer system, any wear that occurs will involve the hammers 26 and the bushings. Furthermore, because the neck portions of the bushings are larger in diameter than the rods, the total area of contact between each hammer 26 and bushing is greater than an area of contact that would exist between each hammer 26 and rod if the hammers 26 were mounted directly on the rods. This larger area of contact between the bushings and the hammers will result in less wear on both the hammers 26 and the bushings.

A third bushing 38 is positioned between the second bushing 36 and the second rotor disc 12*b*. The third bushing 38 includes a neck portion 76 and a spacer portion 78 and may be similar or identical to the first 34 and second 36 bushings in size and shape with the exception that an axial length $d_3$ of the neck portion 76 of the third bushing 38 is less than the corresponding axial length $d_3$ of the neck portions 50 of the first 34 and second 36 bushings due to the fact that the neck portion 78 of the third bushing 38 engages a planar surface of the second rotor disc 12*b* rather than a recess of another bushing. By way of example, the neck portion 76 of the third bushing 38 may present a length that is approximately equal to or greater than a thickness of the hammer 26. In the illustrated embodiment, the axial length $d_3$ of the neck portion 76 is approximately one-half the length of the neck portions 50 of the first 34 and second 36 bushings. A hammer 26 is placed on the neck portion 76 of the third bushing 38 such that the hammer 26 can rotate about the bushing 38, wherein the spacer portion 78 of the bushing 38 and the second rotor disc 12*b* prevent lateral movement of the hammer 26.

A fourth bushing 40 is positioned between the first bushing 34 and the third disc rotor 12*c*. The fourth bushing 40 includes a neck portion 80 and a spacer portion 82, and may be similar or identical to the first 34 and second 36 bushings in size and shape with the exception that the fourth bushing 40 does not include a recess, as the spacer portion 82 is adjacent the third rotor disc 12*c* and does not engage another bushing. A hammer 26 is placed on the neck portion 80 of the fourth bushing 40 such that the hammer 26 can rotate about the bushing 40, wherein the spacer portion 82 of the bushing 40 and the spacer portion 50 of the first bushing 34 prevent lateral movement of the hammer 26.

While the bushings corresponding to the second section 48*b* of the first rod 16 have been described, it will be appreciated that the bushings corresponding to section 48*b* of the third rod 20 are similarly or identically configured and placed on the rod 20. Furthermore, all other sections 48 of the first 16 and third 20 rods between the second section 48*b* and the second end 32 of the rotor 10 may include identical bushings, placed in an identical pattern, as the bushings corresponding to the second section 48*b* of the first rod 16 described above.

The first section 48*a* of the first rod 16 may be the same length as the second section 48*b* and may include a locking collar 28 that includes, for example, opposed arcuate portions and a pair of locking bolts for securing the opposed arcuate portions on the rod 16. Bushings may be used in the first section 48*a* that are specially configured or adapted to accommodate the locking collar 28 (or other component). In the illustrated embodiment, a fifth bushing 42 is placed adjacent the first rotor disc 12a and may be identical in size and shape to the third bushing 38. A sixth bushing 44 is positioned between the fifth bushing 42 and the locking collar 28 and includes a first neck portion 84, a spacer portion 86, and a second neck portion 88 opposite the first neck portion 84. As illustrated in FIG. 5, the first neck portion 84 engages a recess in the fifth bushing and supports a hammer 26, while the second neck portion 88 is engages the locking collar 28 and supports another hammer 26. The first neck portion 84 of the sixth bushing 44 may be identical to the neck portion 50 of the first 34 and second 36 bushings, and the spacer portion 86 of the sixth bushing 44 may be identical to the spacer portion 54 of the first bushing 34 except that the spacer portion 86 of the sixth bushing 44 does not include a recess. The second neck portion 88 of the sixth bushing 44 may be identical to the neck portion 76 of the third bushing 38.

A seventh bushing 46 is positioned between the locking collar 28 and the second rotor disc 12*b* and includes a spacer portion 90 adjacent the disc 12*b* and a neck portion 92 adjacent the locking collar 28. The seventh bushing 46 may be identical to the fourth bushing 40 except that an axial length $d_3$ of the neck portion 92 of the seventh bushing 46 is approximately one-half the length of a corresponding axial length $d_3$ the neck portion 80 of the fourth bushing 40.

With reference to FIG. 6, the bushings used on the second hammer rod 18 may be identical to the bushings used on the first hammer rod 16 and described above, except that the bushings are positioned differently on the second rod 18. In particular, each section 48 of the second rod 18 may include the same bushings present on the corresponding section of the first rod 16 except that the bushing pattern is reversed—that is, the bushings on the second rod 18 are placed in a reverse order and rotated end-for-end relative to the bushings on the first rod 16. As explained below in greater detail, this difference in bushing placement patterns enables the hammers on each rod to be offset from the hammers on other rods.

The second section 48*b* (and every other section 48 between the second section 48*b* and the second end 32 of the rotor 10) of the second rod 18 includes a first, second, third and fourth bushings 34', 36', 38' and 40' that are identical in size and shape the bushings 34, 36, 38 and 40, respectively. However, each of the bushings 34', 36', 38' and 40' is positioned such that the neck portions extend toward the third disc 12*c* rather than the second disc 12*b*. Furthermore, the fourth bushing 40' is positioned adjacent the second disc 12*b* rather than the third disc 12*c*, the third bushing 38' is positioned adjacent the third disc 12*c* rather than the second disc 12*b*, and the positions of the first and second bushings 34' and 36' are transposed relative to the positions of the first and second bushings 34 and 36. Similarly, the bushings on the first section 48*a* of the second rod 18 may be identical in size and shape to the bushings on the first section 48*a* of the first rod 16, described above, except that the bushings on the second rod 18 are placed in a reverse order and rotated end-for-end relative to the bushings on the first rod 16. The bushings on the fourth rod 22 may be identical in size, shape and placement as the bushings on the second rod 18.

As illustrated in FIG. 4, the difference in bushing patterns between the rods 16,18,20,22 results in the hammers 26 on the first and third rods 16,20 being offset or staggered relative to the hammers on the second and fourth rods 18,22. The staggered formation improves the efficiency of the hammer mill by increasing the impact area of the hammers 26.

While the particular dimensions and proportions of the bushing are not critical to the present invention, certain preferred dimensions of one exemplary embodiment of the invention will be discussed for illustrative purposes only, and should not be interpreted as limiting the scope of the present invention.

Figures 9, 10, 11, 12, 13:
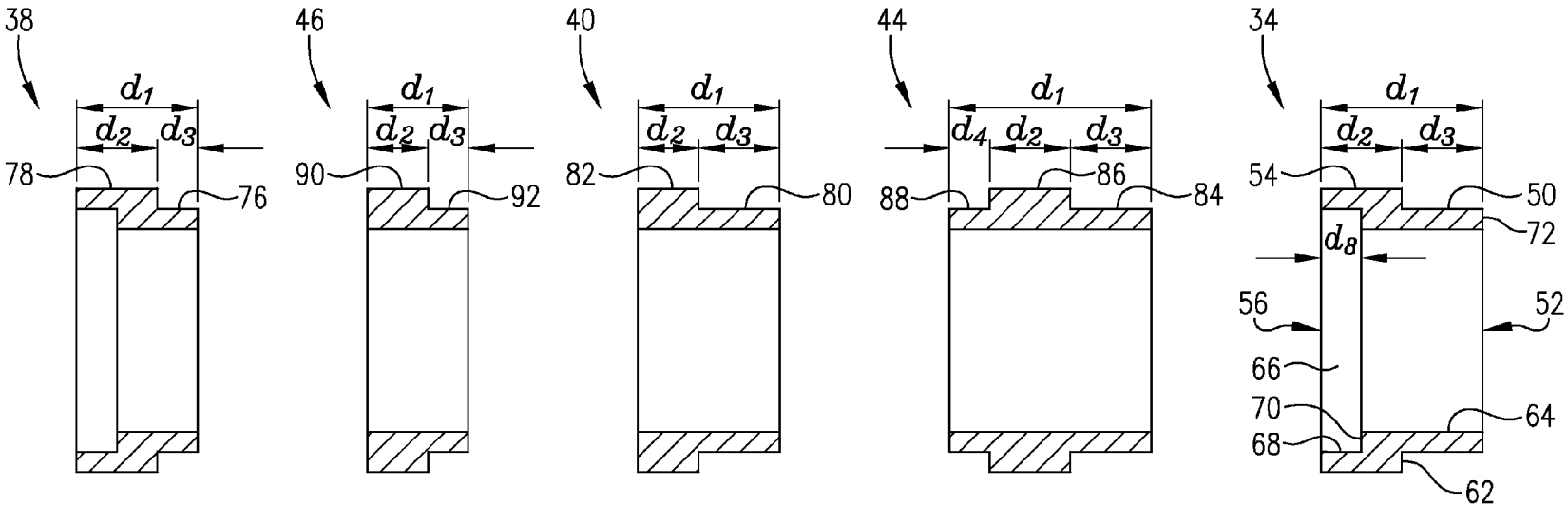
FIG. 9 is a cross-sectional side elevation view of a first exemplary bushing for use in various embodiments of the bushing and spacer system.
FIG. 10 is a cross-sectional side elevation view of a second exemplary bushing for use in various embodiments of the bushing and spacer system.
FIG. 11 is a cross-sectional side elevation view of a third exemplary bushing for use in various embodiments of the bushing and spacer system.
FIG. 12 is a cross-sectional side elevation view of a fourth exemplary bushing for use in various embodiments of the bushing and spacer system.
FIG. 13 is a cross-sectional side elevation view of a fifth exemplary bushing for use in various embodiments of the bushing and spacer system.

With particular reference to FIG. 13, the axial length $d_1$ of the first bushing 34 is preferably within the range of from about one-half of an inch to about two inches, more preferably within the range of from about three-quarters of an inch to about one and one-half inches, and may particularly be about one inch or about one and one-quarter inch. The axial length $d_2$ of the spacer portion 54 of the bushing 34 is preferably within the range of from about one-quarter of an inch to about three-quarters of an inch and may particularly be about one-half of an inch. The axial length $d_3$ of the neck portion 50 of the bushing 34 is preferably within the range of from about one-quarter of an inch to about three-quarters of an inch and may particularly be about one-half of an inch. The axial length $d_8$ of the recess 66 is preferably within the range of from about one-eighth of an inch to about one-half of an inch and may particularly be about one-quarter of an inch.

The thickness of the hammers 26, the axial length $d_3$ of the neck portion 50 of the bushing 34, and the axial length $d_8$ of the recess 66 are interrelated. The space between the spacer portion 54 of the first bushing 34 and the spacer portion 54 of the second bushing 36 is such that the hammer 26, when mounted on the neck portion 50 of the bushing 34, can freely rotate about the neck portion 50 but is restricted from moving laterally (i.e., along the longitudinal axis of the rod 16) by the spacer portions 54 of the bushings 34,36. If the hammer 26 is one-quarter of an inch thick, for example, the axial length $d_3$ of the neck portion 50 may be about one-half of an inch and the axial length $d_8$ of the recess 66 may be about one-quarter of an inch, or slightly less than one-quarter of an inch. This is but one example.

The diameter of the hammer rod 16 is preferably within the range of from about one-half inch to about two inches, more preferably within the range of from about one inch to about one and one-half inches, and may particularly be about one and one-quarter inches in diameter. The first inner cylindrical surface 64 of the bushing 34 is sized such that it may slidingly engage the rod 16 and thus may be slightly greater in diameter than the rod 16, such as one-sixteenth or one-eighth of an inch greater. The first cylindrical outer surface 58 of the neck portion 50 of the bushing 34 preferably has a diameter within the range of from about one-half inch to about three inches and more preferably from about one inches to about two inches, and may particularly be about one and one-quarter inches, one and one-half inches or about one and three-quarter inches. The diameter of the second cylindrical outer surface 60 of the bushing 34 is preferably within the range of from about three-quarters of an inch to about three inches and more preferably from about one and one-quarter inch to about two and one-half inches, and may particularly be about one and one-half inches, one and three-quarters inches or about two inches. The inner and outer diameters of the other bushings 36-46 and 34'-46' may be similar or identical in size to corresponding inner and outer diameters of the first bushing 34 and will therefore not be described in detail.

The ratio of the outer diameter of the hammer rod 16 to the diameter of the first outer surface 58 corresponding to the neck portion 50 of the first bushing 34 (or the diameter of the hammer aperture 74) is preferably between about 0.4 and about 0.95, more preferably between about 0.6 and about 0.9, and may particularly be about 0.7 or 0.8. The ratio of the outer diameter of the hammer rod 16 to the diameter of the second outer surface 60 corresponding to the spacer portion 54 of the bushing 34 is preferably between about 0.2 and about 0.95, more preferably between about 0.4 and 0.9, and may particularly be about 0.6, about 0.7 or about 0.8. The ratio of the diameter of the first outer surface 58 to the second outer surface 60 is preferably between about 0.4 and about 0.95, more preferably between about 0.6 and 0.9, and may particularly be about 0.75, about 0.8, or about 0.85. The ratio of the width of a hammer 26 to the diameter of the hammer aperture 74 is preferably between about 0.25 and 0.75, more preferably between about 0.35 and 0.65, and may particularly be about 0.45 or about 0.55. The ratio of the thickness of a hammer 26 to the axial length $d_2$ of the spacer portion 54 of the first bushing 34 is preferably between about 0.5 and 1.5, more preferably between about 0.75 and about 1.25 and may particularly be about 0.85, about 1.0 or about 1.15.

As described above, the bushings are configured to be slidably mounted on the hammer rods 16,18,20,22. It will be appreciated that such a configuration facilitates assembly of the rotor 10. By way of example, the rotor 10 may be assembled by sliding a rotor disc 12 onto the rods 16,18,20,22, then sliding the bushings and hammers 26 corresponding to that section 48 onto the rods 16,18,20,22, then sliding the next rotor disc 12 onto the rods 16,18,20,22. This process is repeated for each section 48 of the rotor 10 until all sections 48 have been assembled.

Although the invention has been described with reference to the exemplary embodiments illustrated in the attached drawings, it is noted that equivalents may be employed and substitutions made herein without departing from the scope of the invention as recited in the claims. For example, the spacer portions of the bushings need not present a cross section that is perfectly cylindrical, but could present a cross section that is oval or other shape.

The invention claimed is:

1. A bushing system for a hammer mill, the bushing system comprising:

a rod;

a first bushing mounted on the rod, the first bushing including a recess with a first inner surface having a first inner diameter wherein the first inner surface is spaced apart from the rod;

a second bushing including a spacer portion with a first outer diameter and a neck portion with a second outer diameter smaller than the first outer diameter and the first inner diameter of the recess, the second bushing being mounted on the rod adjacent to the first bushing such that the neck portion of the second bushing is positioned in the recess of the first bushing; and a hammer rotatably mounted on the neck portion of the second bushing.

2. The bushing system of claim 1, the hammer including a circular aperture engaging the neck portion of the second bushing.

3. The bushing system of claim 2, the hammer presenting an elongated, planar shape with the aperture being located proximate an end of the hammer.

4. The bushing system of claim 1, the first bushing and the second bushing being positioned such that a space between the first bushing and the spacer portion of the second bushing is slightly greater than a thickness of the hammer, thereby allowing the hammer to rotate about the neck portion of the second bushing but preventing movement of the hammer along a longitudinal axis of the rod.

5. The bushing system of claim 1, the first bushing and the second bushing being slidably mounted on the rod and completely encircling the rod.

6. The bushing system of claim 1, the spacer portion and the neck portion of the second bushing each presenting a cylindrical shape with a uniform outer diameter.

7. The bushing system of claim 6, the ratio of an outer diameter of the neck portion to an outer diameter of the spacer portion being between 0.7 and 0.9.

8. The bushing system of claim 1, the ratio of an outer diameter of the rod to an outer diameter of the neck portion being between 0.65 and 0.95.

9. The bushing system of claim 1, the ratio of a thickness of the hammer to a width of the spacer portion being between 0.5 and 1.0.

10. The bushing system of claim 1, the first bushing including a spacer portion and a neck portion, the spacer portion presenting a larger outer diameter than the neck portion, the spacer portion being positioned adjacent the neck portion of the second bushing.

11. The bushing system of claim 10, further comprising a second hammer rotatably mounted on the neck portion of the first bushing.

12. The bushing system of claim 1, the first bushing and the second bushing each presenting an axial length within the range of from about one-half inch to about two inches.

13. A bushing system for a hammer mill, the bushing system comprising:

a rod;

a first bushing removably mounted on the rod, the first bushing including a cylindrical spacer portion corresponding to a first axial end of the bushing and a cylindrical neck portion corresponding to a second axial end of the bushing, the spacer portion presenting a larger outer diameter than the neck portion and including a cylindrical recess;

a second bushing including a cylindrical spacer portion corresponding to a first axial end and a cylindrical neck portion corresponding to a second axial end, the spacer portion presenting a larger outer diameter than the neck portion, the second bushing being removably mounted on the rod such that the neck portion of the second bushing is positioned in the cylindrical recess of the first bushing; and a hammer presenting an elongated, planar shape with a circular aperture proximate an end of the hammer, the circular aperture presenting a diameter that is greater than the outer diameter of the neck portion of the second bushing but less than the outer diameter of each of the spacer portions of the first and second bushings, the hammer being mounted on the neck portion of the second bushing such that the aperture rotatably engages the neck portion.

14. The bushing system of claim 13, the first bushing and the second bushing being positioned such that a space between the spacer portions of the first and second bushings is approximately equal to a width of the hammer.

15. The bushing system of claim 13, further comprising a second hammer rotatably mounted on the neck portion of the first bushing.

16. The bushing system of claim 13, the first bushing and the second bushing each presenting an axial length within the range of from about one-half inch to about two inches.

* * * * *